US006523969B2

(12) United States Patent
Yang et al.

(10) Patent No.: US 6,523,969 B2
(45) Date of Patent: Feb. 25, 2003

(54) ILLUMINATING DEVICE

(76) Inventors: Chien-Jen Yang, 5-12 Floor, No. 2, Sec. 4, Chung-Hsiao East Rd., Taipei City (TW); Sheng-Shyong Kao, 5-12 Floor, No. 2, Sec. 4, Chung-Hsiao East Rd., Taipei City (TW); Ko-Chien Liu, 5-12 Floor, No. 2, Sec. 4, Chung-Hsiao East Rd., Taipei City (TW)

( * ) Notice: Subject to any disclaimer, the term of this patent is extended or adjusted under 35 U.S.C. 154(b) by 36 days.

(21) Appl. No.: 09/907,648

(22) Filed: Jul. 19, 2001

(65) Prior Publication Data

US 2003/0016530 A1 Jan. 23, 2003

(51) Int. Cl.[7] ..... F21W 131/30
(52) U.S. Cl. ..... 362/118; 362/205; 362/206
(58) Field of Search ..... 362/118, 109, 362/205, 206, 203

(56) References Cited

U.S. PATENT DOCUMENTS 5,720,541 A * 2/1998 Bayles ..... 362/118
5,803,583 A * 9/1998 Hsieh ..... 362/118
6,106,132 A * 8/2000 Chen ..... 362/118
6,238,119 B1 * 5/2001 Liu ..... 362/118

* cited by examiner

*Primary Examiner*—Laura K. Tso

(57) ABSTRACT

An illuminating device includes a casing having a movable module movably received therein. A first spring is biased between a first end of the movable module and an inside of the close end of the casing. An illuminating member is connected to a second end of the movable module and located in the open end of the casing. A circuit board is connected to the illuminating member and a second spring is biased between the circuit board and a plurality of batteries. A switch device is connected to the batteries and has a button extending from the first end of the movable module. When pushing the second end of the movable module, the button is compressed by the inside of the casing to turn on the illuminating member.

7 Claims, 5 Drawing Sheets

ILLUMINATING DEVICE

FIELD OF THE INVENTION

The present invention relates to an illuminating device having a movable module received in a casing and when the movable module is pushed, a switch device is activated to turn the illumination member.

BACKGROUND OF THE INVENTION

A conventional illuminating device known to applicant is shown in FIG. 1 and is connected to a top section of a pen. A light 11 is received in the top end of the pen and a rotatable casing 10 is rotated by the user to turn on the light 11. This type of the illuminating device actually is operated by two hands, one hand holding on the lower section, the pen section, and the other hand rotating the rotatable casing 10. This is not convenient for the user because two hands are required to operate it. The other type of conventional illuminating device is shown in FIG. 2 and includes a button 13 connected on the casing 12 so that the user uses only one hand can turn on the light 14. However, the button 13 has to be pressed all the way to keep the light 14 being operated.

SUMMARY OF THE INVENTION

In accordance with one aspect of the present invention, there is provided an illuminating device which comprises a casing having an open end and a close end. A movable module is movably received in the casing and a first spring is biased between a first end of the movable module and an inside of the close end of the casing. An illuminating member is connected to a second end of the movable module and located in the open end of the casing. A circuit board is connected to the illuminating member and a second spring is biased between the circuit board and a plurality of batteries. A switch device is connected to the batteries and a button extending from the first end of the movable module.

The primary object of the present invention is to provide an illuminating device that has a movable module received in the casing so that the whole structure of the illuminating device is simplified.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 4 is a cross sectional view to show the illuminating device in FIG. 3 wherein the illuminating member is turned on;

DETAILED DESCRIPTION OF THE PREFERRED EMBODIMENT

Figure 1:
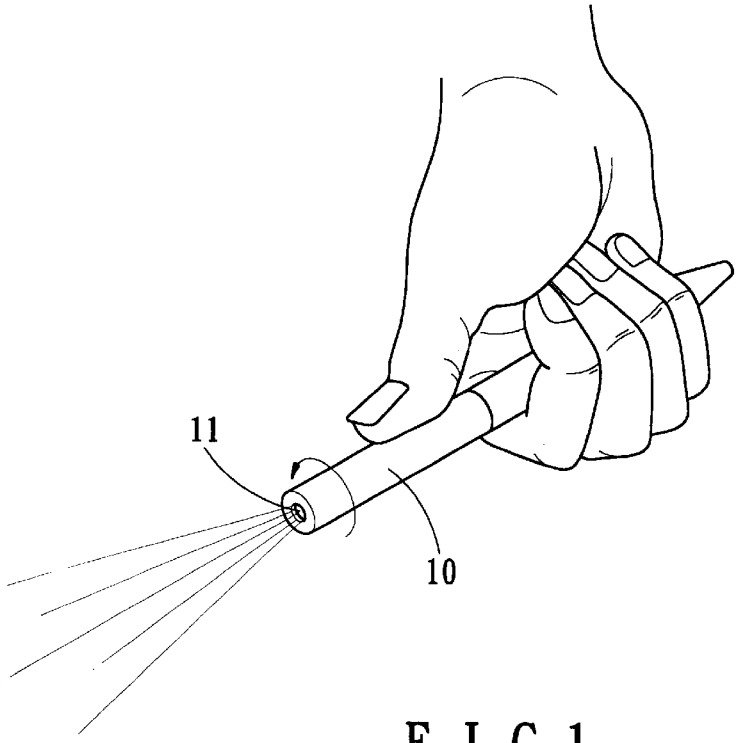
F I G. 1 PRIOR ART
FIG 1 is a perspective view to show a conventional illuminating device.
Figure 2:
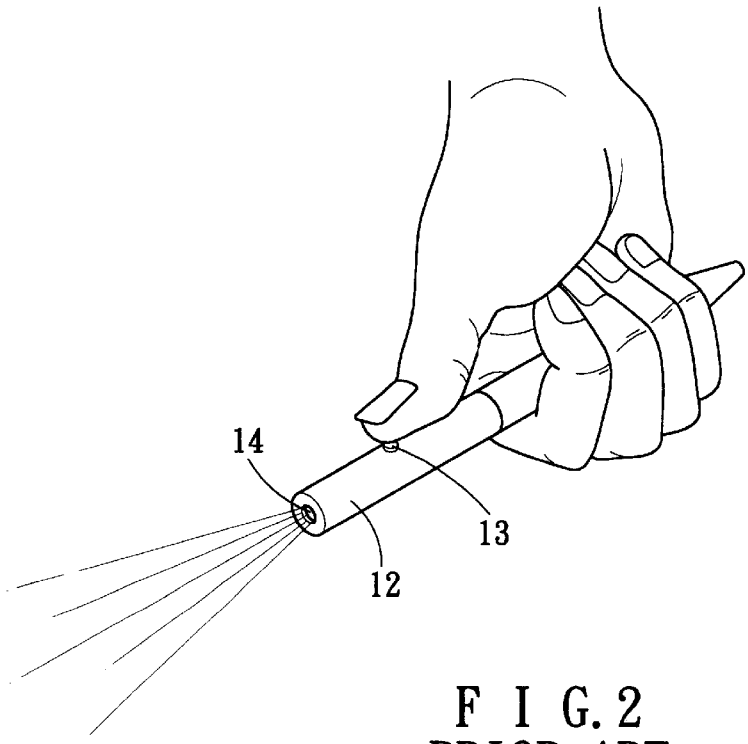
F I G. 2 PRIOR ART
FIG. 2 is a perspective view to show another conventional illuminating device.
Figure 3:
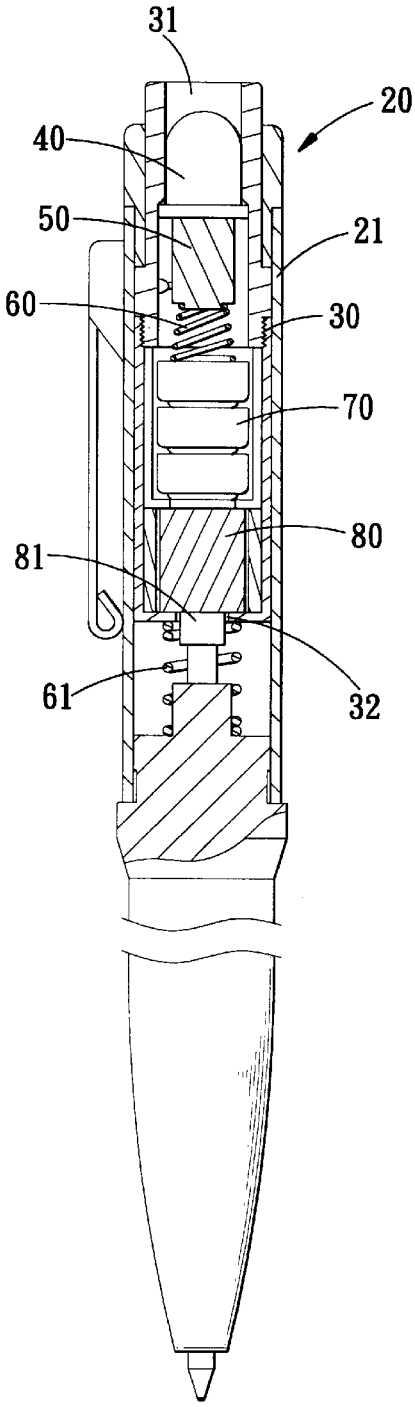
FIG. 3 is a cross sectional view to show an illuminating device of the present invention.
Figure 4:
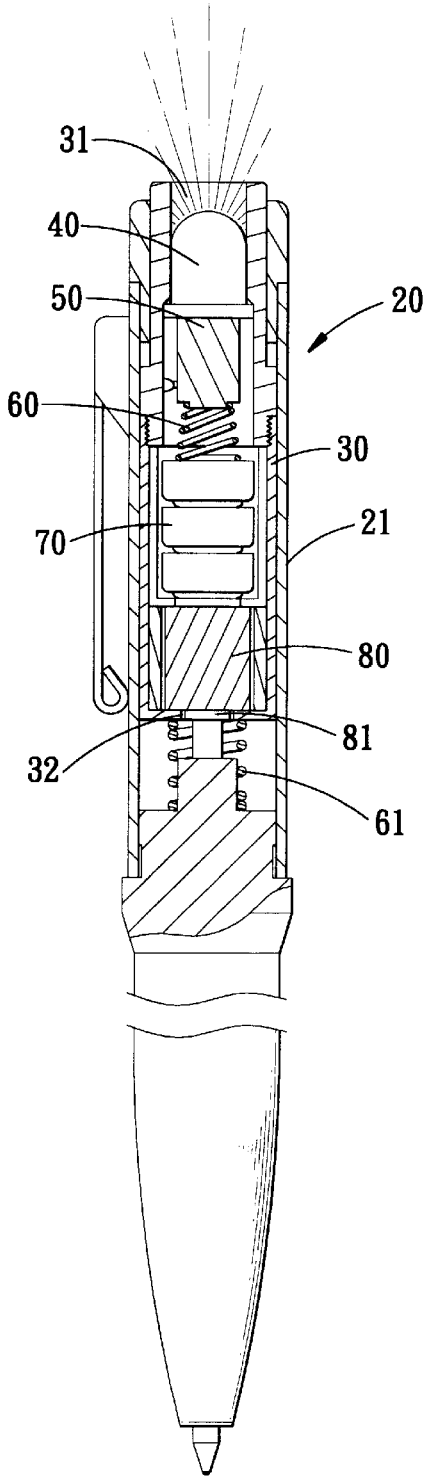
Figure 5:
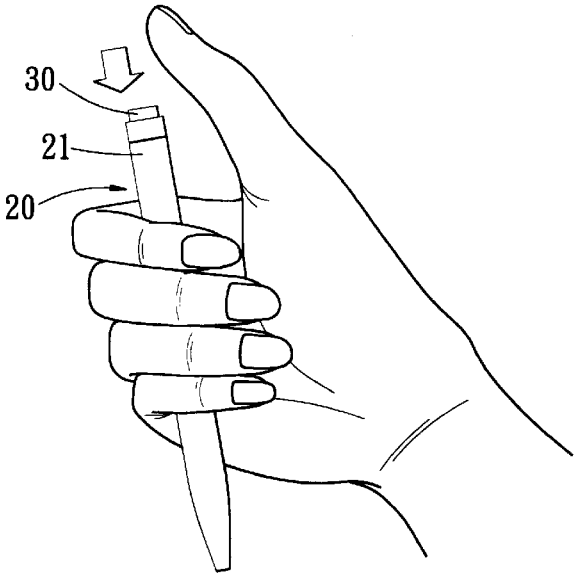
FIG. 5 an illustrative view to show a user's thumb is going to push the second end of the movable module of the illuminating device of the present invention.
Figure 6:
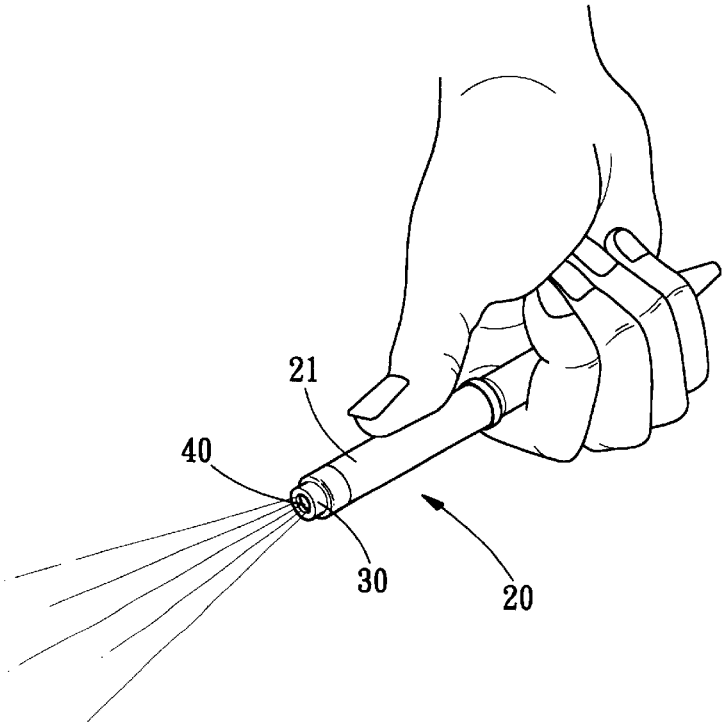
FIG. 6 is an illustrative view to show the illuminating member is turned on by pushing the second end of the movable module of the illuminating device of the present invention.

Referring to FIGS. 3 to 6, the illuminating device 20 of the present invention comprises a casing 21 having an open end and a close end which is a ball-pen end. A movable module 30 is movably received in the casing 21 and a first spring 61 is biased between a first end of the movable module 30 and an inside of the close end of the casing 21. An illuminating member 40 is connected to a second end which is an open end 31, of the movable module 30 and located in the open end of the casing 21. A circuit board 50 is connected to the illuminating member 40 and a second spring 60 is biased between the circuit board 50 and a plurality of batteries 70. A switch device 80 is connected to the batteries 70 and a button 81 extending from an opening 32 defined in the first end of the movable module 30. The first spring 61 is mounted on the button 81 of the switch device 80 and a rod extending from the inside of the close end of the casing 21.

When pushing the second end of the movable module 30, the button 81 is moved to be compressed so as to let the illuminating member 40 turn on. It is to be noted that a lens and/or a pattern plate can be engaged with the open end 31 of the movable module 30 so as to obtain an variable or colorful illusion.

Figure 7:
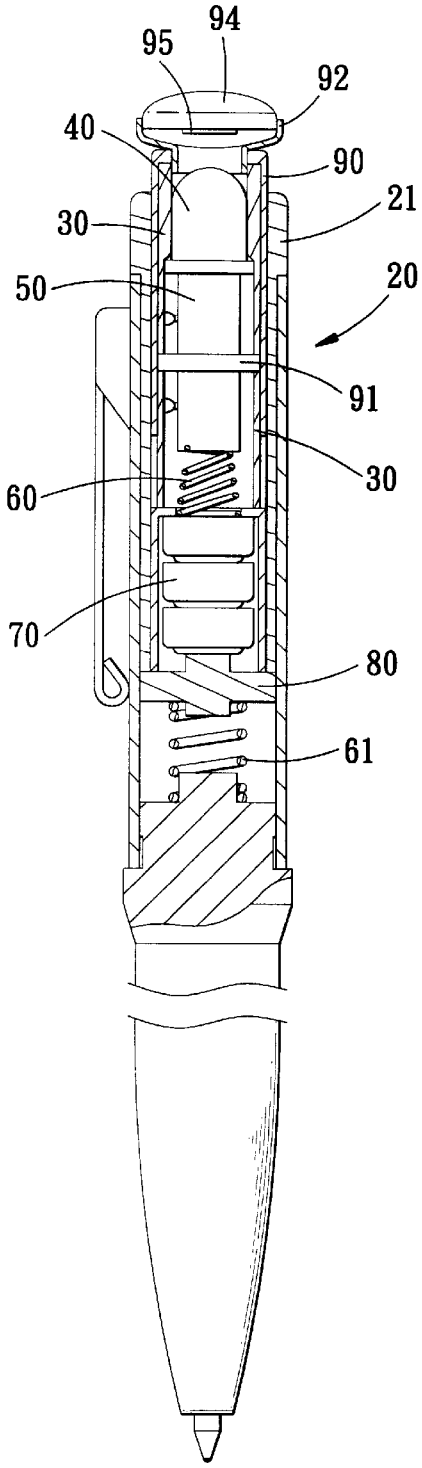
FIG. 7 is a cross sectional view to show another embodiment of an illuminating device of the present invention.
Figure 8:
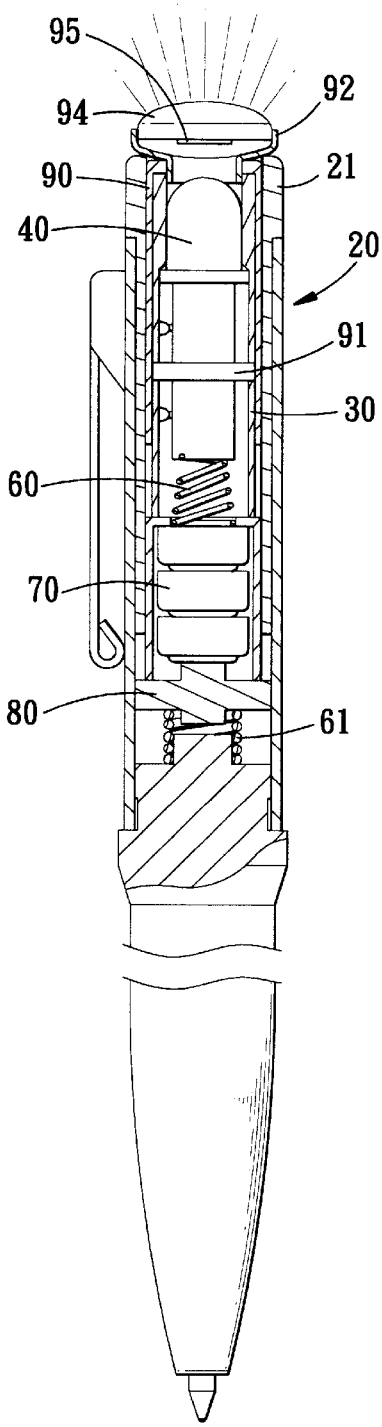
FIG. 8 is a cross sectional view to show the illuminating device in FIG. 7 wherein the illuminating member is turned on, and FIG. 9 shows that the illuminating device is connected with a key ring.

As shown in FIGS. 7 and 8, another embodiment of the illuminating device 20 comprises a conductive casing 21 having an open end and a close end which is a ball-pen end. A movable module 30 movably received in a plastic tube 90 which is movably received in the casing 21. A conductive member 80 is connected to a first end of the movable module 30 and a first spring 61 is biased between the conductive member 80 and an inside of the close end of the casing 21. A periphery of the conductive member 80 movably contacts an inside of the conductive casing 21. An illuminating member 40 is connected to a second end of the movable module 30 and located in the open end of the casing 21. A circuit board 50 is connected to the illuminating member 40 and a second spring 60 is biased between the circuit board 50 and a plurality of batteries 70. A conductive cup 92 is connected to the second end of the movable module 30 and will be moved to contact the conductive casing 21 when being pushed. A lens 94 and a pattern plate 95 are connected to the conductive cup 92. Therefore, when pushing the conductive cup 92 to contact the conductive casing 21, the illuminating member 40 turns on.

Figure 9:
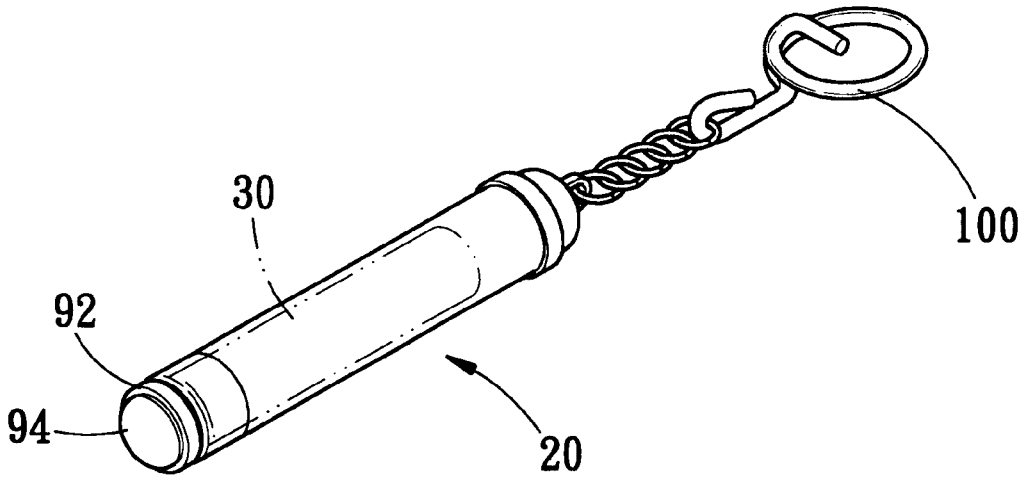

The movable module 30 includes two sections and a non-conductive ring 91 is mounted to the circuit board 50 and located between the two sections of the movable module 30. The non-conductive ring 91 ensures that the two sections of the movable module 30 is electrically separated. As shown in FIG. 9, the illuminating device 20 can be connected to a key ring 100 or any objects.

While we have shown and described the embodiment in accordance with the present invention, it should be clear to those skilled in the art that further embodiments may be made without departing from the scope of the present invention.

What is claimed is:

1. An illuminating device comprising:

a casing having an open end and a close end;

a movable module movably received in said casing and a first spring biased between a first end of said movable module and an inside of said close end of said casing, an illuminating member connected to a second end of said movable module and located in said open end of said casing, a circuit board connected to said illuminating member;

a second spring biased between said circuit board and a plurality of batteries, and a switch device connected to said batteries and a button extending from said switch device, said button protruding from said first end of said movable module.

2. The illuminating device as claimed in claim 1 further comprising a lens connected to said second end of said movable module.

3. The illuminating device as claimed in claim 1 further comprising a pattern plate connected to said second end of said movable module.

4. An illuminating device comprising:

a conductive casing having an open end and a close end;

a movable module movably received in said casing and a conductive member connected to a first end of said movable module, a first spring biased between said conductive member and an inside of said close end of said casing, a periphery of said conductive member movably contacting an inside of said conductive casing, an illuminating member connected to a second end of said movable module and located in said open end of said casing, a circuit board connected to said illuminating member;

a second spring biased between said circuit board and a plurality of batteries, and a conductive cup connected to said second end of said movable module and being moved to contact said conductive casing when being pushed.

5. The illuminating device as claimed in claim 4 further comprising a lens connected to said conductive cup.

6. The illuminating device as claimed in claim 4 further comprising a pattern plate connected to said conductive cup.

7. The illuminating device as claimed in claim 4 wherein said movable module includes two sections, a non-conductive ring mounted to said circuit board and located between said two sections of said movable module.

* * * * *